US011223144B2

(12) United States Patent
Chen et al.

(10) Patent No.: US 11,223,144 B2
(45) Date of Patent: Jan. 11, 2022

(54) ANTENNA STRUCTURE AND WIRELESS COMMUNICATION DEVICE USING THE SAME

(71) Applicant: Shenzhen Chao-De Communication Co., Ltd, Shenzhen (CN)

(72) Inventors: Kuo-Cheng Chen, New Taipei (TW); Yi-Ming Chen, New Taipei (TW); Siang-Yu Siao, New Taipei (TW)

(73) Assignee: Mobile Drive Netherlands B.V., Amsterdam (NL)

( * ) Notice: Subject to any disclaimer, the term of this patent is extended or adjusted under 35 U.S.C. 154(b) by 338 days.

(21) Appl. No.: 16/419,629

(22) Filed: May 22, 2019

(65) Prior Publication Data

US 2019/0363457 A1 Nov. 28, 2019

Related U.S. Application Data

(60) Provisional application No. 62/674,634, filed on May 22, 2018.

(51) Int. Cl.
*H01Q 21/29* (2006.01)
*H01Q 21/24* (2006.01)
(Continued)

(52) U.S. Cl.
CPC ..... *H01Q 21/245* (2013.01); *H01Q 1/2258* (2013.01); *H01Q 1/2283* (2013.01);
(Continued)

(58) Field of Classification Search
CPC .. H01Q 1/243; H01Q 21/0006; H01Q 21/065; H01Q 21/24; H01Q 21/28;
(Continued)

(56) References Cited

U.S. PATENT DOCUMENTS 9,984,985 B1 * 5/2018 Chiang ..... H01L 23/585
2013/0300629 A1 * 11/2013 Jiang ..... H01Q 21/28 343/853
(Continued)

FOREIGN PATENT DOCUMENTS

CN 204029975 U 12/2014
CN 106058452 A 10/2016
(Continued)

*Primary Examiner* — Alexander H Taningco
*Assistant Examiner* — Amy X Yang
(74) *Attorney, Agent, or Firm* — ScienBiziP, P.C.

(57) ABSTRACT

An antenna structure capable of transmitting radio waves in multiple polarizations is positioned on a circuit board. The circuit board includes upper and lower surfaces and peripheral side wall. The antenna structure includes a first antenna array, a second antenna array, and a control circuit. Each antenna unit of the first antenna array is positioned on one of the upper surface or the lower surface, a portion of each antenna unit of the second array is positioned on the peripheral side wall. The other portion of each antenna unit bended and positioned on at least one of the upper surface or the lower surface. In activating the first antenna array and the second antenna array the control circuit can generate radio transmissions in multiple polarizations. A wireless communication device is also provided.

18 Claims, 10 Drawing Sheets

(51) Int. Cl.

| | |
|---|---|
| ***H01Q 15/10*** | (2006.01) |
| ***H01Q 19/06*** | (2006.01) |
| ***H01Q 1/22*** | (2006.01) |
| ***H01Q 9/06*** | (2006.01) |
| ***H01Q 1/38*** | (2006.01) |
| ***H01Q 21/00*** | (2006.01) |

(52) U.S. Cl.
CPC ..... *H01Q 1/38* (2013.01); *H01Q 9/06* (2013.01); *H01Q 15/10* (2013.01); *H01Q 19/06* (2013.01); *H01Q 21/0006* (2013.01); *H01Q 21/0025* (2013.01); *H01Q 21/29* (2013.01)

(58) Field of Classification Search
CPC ..... H01Q 21/29; H01Q 21/30; H01Q 1/2283; H01Q 9/0428
USPC ..... 343/844
See application file for complete search history.

(56) References Cited

U.S. PATENT DOCUMENTS

| | | | | |
|---|---|---|---|---|
| 2014/0247188 | A1* | 9/2014 | Nakano ..... | H04B 5/0031 343/702 |
| 2016/0006132 | A1* | 1/2016 | Lee ..... | H01Q 21/24 343/835 |
| 2018/0351631 | A1 | 12/2018 | Hamabe et al. | |

FOREIGN PATENT DOCUMENTS

| | | | |
|---|---|---|---|
| CN | 108054163 | A | 5/2018 |
| WO | 2017/134715 | A1 | 8/2017 |

* cited by examiner

ANTENNA STRUCTURE AND WIRELESS COMMUNICATION DEVICE USING THE SAME

FIELD

The subject matter herein generally relates to an antenna structure and a wireless communication device using the antenna structure.

BACKGROUND

The overall appearance and specification such as weight and dimension of wireless communication devices became important. As the wireless communication devices become lighter and thinner, an area of an antenna substrate is increasingly becoming limited. In order to achieve impedance matching while avoiding coupling effects between lines, the number of radiating elements that can be positioned in the area is also limited. A microstrip antenna is adopted to transmit and receive multiple signals in multiple input/output antenna systems, however, these signals may interfere with each other, which decreases antenna transmission efficiency.

Therefore, there is room for improvement within the art.

BRIEF DESCRIPTION OF THE DRAWINGS

Implementations of the present technology will now be described, by way of example only, with reference to the attached figures.

DETAILED DESCRIPTION

Figure 1:
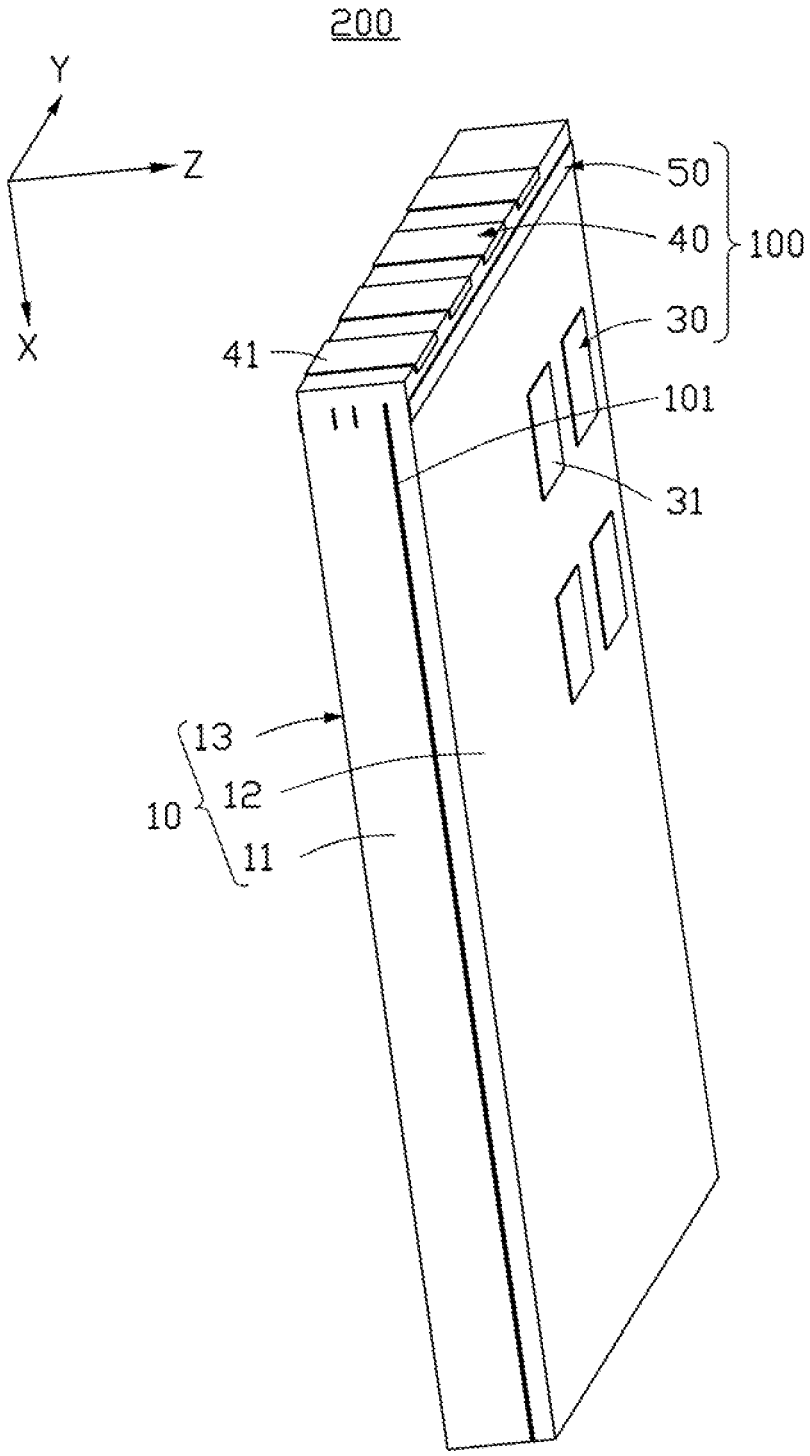
FIG. 1 is an isometric view of an embodiment of a wireless communication device using an antenna structure, from one angle.
Figure 2:
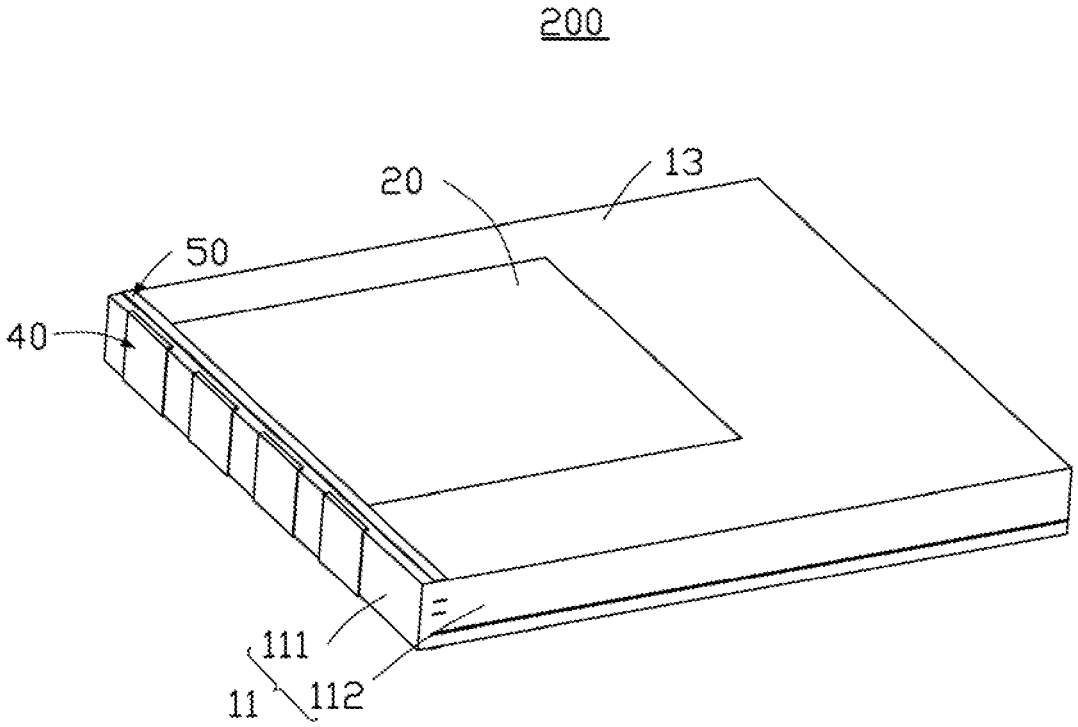
FIG. 2 is similar to FIG. 1, but shown from another angle.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure. It should be noted that references to "an" or "one" embodiment in this disclosure are not necessarily to the same embodiment, and such references mean "at least one."

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The term "coupled" is defined as connected, whether directly or indirectly through intervening components, and is not necessarily limited to physical connections. The connection can be such that the objects are permanently connected or releasably connected.

FIG. 1 shows an embodiment of an antenna structure 100. The antenna structure 100 can be applied to a wireless communication device 200. The antenna structure 100 is configured to transmit and receive wireless signals. The wireless communication device 200 can be a mobile phone, a personal digital assistant, or an MP3 player, for example. The wireless communication device 200 includes a circuit board 10. The wireless communication device 200 can further include, but is not limited to, other mechanical structures, electronic components, modules, and software.

The circuit board 10 can be a printed circuit board (PCB). The circuit board 10 itself is made of dielectric material, for example, epoxy resin glass fiber (FR4) or the like. The circuit board 10 includes a side wall 11, an upper surface 12, and a lower surface 13 opposite to the upper surface 12. The side wall 11 connects the upper surface 12 and the lower surface 13. The side wall 11 includes two first walls 111 and two second walls 112. The two first walls 111 are positioned opposite to each other. The two second walls 112 are positioned opposite to each other. The two first walls 111 and the two second walls 112 can be seen as effectively forming a frame (not shown). The frame is substantially rectangular-shaped and is configured to hold the antenna structure 100.

The antenna structure 100 includes a control circuit 20, a first antenna array 30, a second antenna array 40, and a ground portion 50. The ground portion 50 is configured for grounding the first antenna array 30 and the second antenna array 40.

The circuit board 10 includes a middle layer 101. The middle layer 101 is electrically connected to the control circuit 20. The middle layer 101 is positioned between the upper surface 12 and the lower surface 13. The middle layer 101 is configured to provide a feed signal for the first antenna array 30 and the second antenna array 40. The middle layer 101 further includes a ground plane (not shown). The ground plane is electrically connected to both the first antenna array 30 and the second antenna array 40.

In an embodiment, for example, the middle layer 101 and the control circuit 20 are both rectangular-shaped structures. For convenience of explanation, a length of the middle layer 101 in a Y-axis direction is defined as a first width. A length of the circuit board 10 in the Y-axis direction is defined as a second width. A length of the middle layer 101 in an X-axis direction is defined as a first length. A length of the circuit board 10 in the X-axis direction is defined as a second length. The first width equals the second width. The first length is greater than the second length.

Referring to FIG. 1, a first end of the middle layer 101 is aligned with a first end of the circuit board 10. The first end of the circuit board 10 is defined as a first wall 111. The first wall 111 is not positioned with the second antenna array 40. A second end of the circuit board 10 is defined as another first wall 111. Another first wall 111 is positioned with the second antenna array 40. The second antenna array 40 is positioned adjacent to the top wall of the circuit board 10.

The control circuit 20 is positioned on one of the upper surface 12 or the lower surface 13. In an embodiment, a groove (not shown) is defined in one of the upper surface 12 or the lower surface 13. The groove is configured to receive the control circuit 20, so a thickness of the antenna structure 100 is not increased. In this embodiment, for example, the control circuit 20 is substantially rectangular-shaped.

In one embodiment, for example, the control circuit 20 can be a System on Chip (SOC). The control circuit 20 is configured to provide a feed signal to the antenna structure 100. The control circuit 20 is further configured to control radiation orientation or polarity of the first antenna array 30 and a phase of the feed signal for the second antenna array 40. The control circuit 20 is still further configured to cause the first antenna array 30 and the second antenna array 40 to generate radiations in multiple polarizations.

In one embodiment, the first antenna array 30 is positioned on whichever one of the upper surface 12 and the lower surface 13 that does not carry or support the control circuit 20. That is, the control circuit 20 is positioned on one of the upper surface 12 or the lower surface 13. The first antenna array 30 is positioned in opposition on one of the upper surface 12 or the lower surface 13 not have the control circuit 20. The first antenna array 30 and the control circuit 20 are not coplanar and are positioned opposite to each other. In other embodiments, the first antenna array 30 can be positioned on the side wall 11. The first antenna array 30 can be positioned on the first wall 111 and/or the second wall 112. The first antenna array 30 can be made of a metal material, for example, a copper foil.

In an embodiment, the first antenna array 30 includes N*M first antenna units 31. N and M are integers greater than 1. The N rows of the first antenna array 30 are arranged in a first direction, for example, an X-axis direction. The M rows of the first antenna array 30 are arranged in a second direction, for example, a Y-axis direction. The first antenna array 30 is a half wavelength antenna, a shape and size of each N*M first antenna units 31 are substantially the same. Each first antenna unit 31 is substantially rectangular-shaped. A length and width of each first antenna unit 31 is the half wavelength of the frequency of the wireless signal to be received and transmitted.

Sides of each first antenna unit 31 are separately positioned along the X-axis direction and the Y-axis direction. A length of each first antenna unit 31 in the X-axis direction is defined as a third length. A length of each first antenna unit 31 in the Y-axis direction is defined as a third width. The third length equals the third width. An edge distance between each N*M first antenna unit 31 is the half wavelength. The edge distance is a distance between two adjacent sides of the first antenna unit 31 along the X-axis or along the Y-axis direction. "Wavelength" refers to a wavelength of a radio wave transmitted or received by the antenna structure 100. The wavelength is a fixed and stable value.

Figure 3:
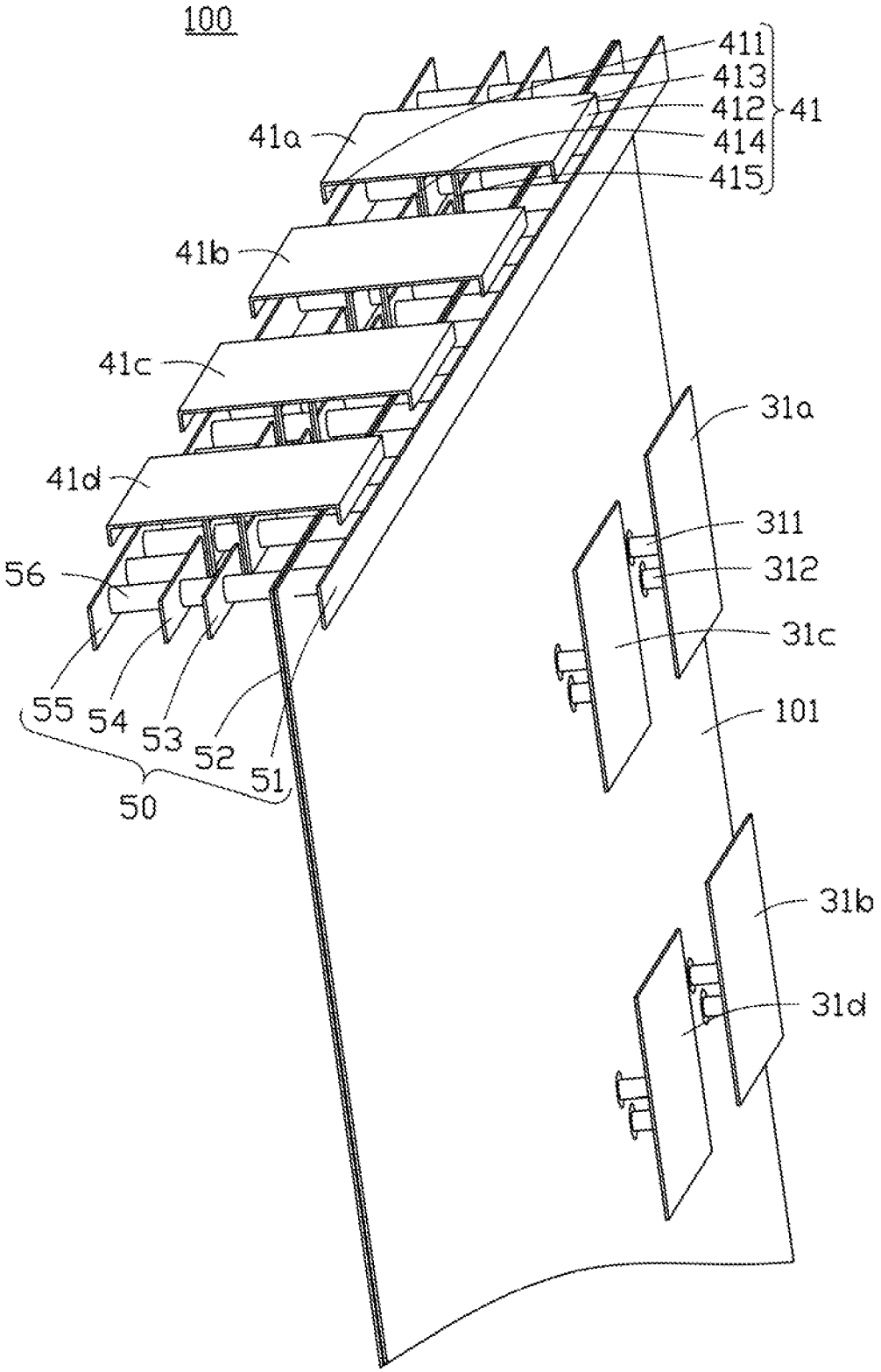
FIG. 3 is an isometric view of an embodiment of the antenna structure of FIG. 1.

In one embodiment, referring to FIG. 3, the N is 2, and the M is 2. The first antenna array 30 includes 2*2 first antenna units 31. The 2*2 first antenna units 31 are individually indicated by 31*a*-31*d*, respectively.

In another embodiment, when the N is 1 and the M is 4, the first antenna array 30 includes 1*4 first antenna units 31. Because the first antenna array 30 includes only one row, when a thickness of the circuit board 10 is sufficient, the first antenna array 30 can be positioned on the side wall 11.

Referring to FIG. 3, each first antenna unit 31 includes a first feeding portion 311 and a second feeding portion 312. The first feeding portion 311 and the second feeding portion 312 are both metallic columns. One end of the first feeding portion 311 is electrically connected to the first antenna unit 31. Another end of the first feeding portion 311 is electrically connected to a first feeding source (not shown) of the middle layer 101. One end of the second feeding portion 312 is electrically connected to the first antenna unit 31. Another end of the second feeding portion 312 is electrically connected to a second feeding source (not shown) of the middle layer 101. The first feeding portion 311 and the second feeding portion 312 feed current and signals to the first antenna unit 31.

In an embodiment, the second antenna array 40 includes 1*n second antenna units 41. The n is a integer of greater than 1. The n rows of the second antenna units 41 are arranged in the second direction, for example, the Y-axis direction. A portion of each second antenna unit 41 is positioned in the Y-Z plane. Two sides of each second antenna unit 41 are positioned along the Y-axis and the Z-axis. Another portion each second antenna unit 41 is positioned in the X-Y plane. Two sides of each second antenna unit 41 are positioned along the X-axis and the Y-axis.

For convenience of explanation, the length of each second antenna unit 41 in the X-axis direction is defined as a fourth length. The length of each second antenna unit 41 in the Y-axis direction is defined as a fourth width. The length of each second antenna unit 41 in the Z-axis direction is defined as a first height. A total length of the second antenna unit 41 is a sum of the fourth length and the fourth width. A total width of the second antenna unit 41 is equal to the first height.

The second antenna array 40 is a half wavelength antenna. That is, a shape and size of each 1*n second antenna units 41 are the same. A total length and a total width of each second antenna unit 41 are both the half wavelength. Gaps between the 1*n second antenna units 41 are equal to the half wavelength. That is, a distance between each two adjacent antenna elements 41 along the Y-axis direction is the half wavelength. The second antenna unit 41 can be a metallic sheet printed on the circuit board 10, for example, a copper foil piece.

In an embodiment, a thickness of the side wall 11 is less than the half wavelength of the second antenna array 40. The total length of the second antenna unit 41 is the half wavelength. So, a portion of each second antenna unit 41 is positioned on the side wall 11. Another portion of each second antenna unit 41 bended and positioned on the upper surface 12 and/or the lower surface 13. A portion of each second antenna unit 41 is positioned on the first wall 111 and/or the second wall 112. Another portion of each second antenna unit 41 bended and positioned on the upper surface 12 and/or the lower surface 13 with respect to the portion each second antenna unit 41 positioned on the side wall 11. In another embodiment, each second antenna unit 41 can be positioned on the side wall 11 or can be positioned on the upper surface 12 and/or the lower surface 13.

In an embodiment, referring to FIG. 3, the n is 4. The second antenna array 40 includes 1*4 second antenna units 41. The 1*4 second antenna units 41 are individually indicated by 41*a*-41*d*, respectively.

In an embodiment, each second antenna unit 41 includes a first folding portion 411, a second folding portion 412, and a main portion 413. The main portion 413 is positioned on the side wall 11. The first folding portion 411 and the second folding portion 412 are respectively positioned on the upper surface 12 and the lower surface 13. The first folding portion 411 and the second folding portion 412 are both rectangular-shaped. A length of the first folding portion 411 equals a length of the second folding portion 412. A width of the first folding portion 411 equals a width of the second folding portion 412. Opposite ends of the main portion 413 perpendicularly connect to the first folding portion 411 and the second folding portion 412. The first folding portion 411, the second folding portion 412, and the main portion 413 are rectangular-shaped structures, so the second antenna unit 41 is substantially a U-shaped structure.

The width of the first folding portion 411 and the width of the second folding portion 412 equals a width of the main portion 413. The width of the main portion 413 is the half wavelength. A sum of the lengths of the first folding portion 411, the second folding portion 412, and the main portion 413 is also the half wavelength. In other embodiments, a shape and a size of each first folding portion 411 can be different from those of the second folding portion 412.

Each second antenna unit 41 includes a third feeding portion 414 and a fourth feeding portion 415. The third feeding portion 414 and the fourth feeding portion 415 are elongated structures. One end of the third feeding portion 414 is electrically connected to the second antenna unit 41. Another end of the third feeding portion 414 is electrically connected to the control circuit 20. One end of the fourth feeding portion 415 is electrically connected to the second antenna unit 41. Another end of the fourth feeding portion 415 is electrically connected to the control circuit 20. The third feeding portion 414 and the fourth feeding portion 415 feed current and signals to each second antenna unit 41.

In an embodiment, the ground portion 50 includes a first ground plane 51, a second ground plane 52, a third ground plane 53, a fourth ground plane 54, a fifth ground plane 55, and at least one via 56. The first ground plane 51, the third ground plane 53, the fourth ground plane 54, and the fifth ground plane 55 are rectangular-shaped sheet structures. The size and shape of the first ground plane 51, the third ground plane 53, the fourth ground plane 54, and the fifth ground plane 55 are the same. A size and shape of the second ground plane 52 equals a size and shape of the middle layer 101. The middle layer 101 includes the second ground plane 52. The first ground plane 51, the second ground plane 52, the third ground plane 53, the fourth ground plane 54, and the fifth ground plane 55 are in order and in parallel.

The via 56 is a cylindrically-shaped structure. The via 56 passes through from the upper surface 12 to the lower surface 13. The via 56 passes through the upper surface 12, the second ground plane 52, the third ground plane 53, the fourth ground plane 54, and the lower surface 13 in that order. The via 56 is electrically connected to the first ground plane 51 and the fifth ground plane 55.

In an embodiment, the first ground plane 51 is positioned on the upper surface 12, the fifth ground plane 55 is positioned on the lower surface 13. The first ground plane 51 and the fifth ground plane 55 are spaced vertically from each other. The first feeding portion 311 and the second feeding portion 312 are electrically connected to the second ground plane 52. The third feeding portion 414 passes through the fourth ground plane 54 and is electrically connected to the control circuit 20. The fourth feeding portion 415 passes through the third ground plane 53 and is electrically connected to the control circuit 20. The first ground plane 51, the second ground plane 52, the third ground plane 53, the fourth ground plane 54, and the fifth ground plane 55 are all positioned on one side of each second antenna unit 41 that has the first folding portion 411 and the second folding portion 412.

Figure 4:
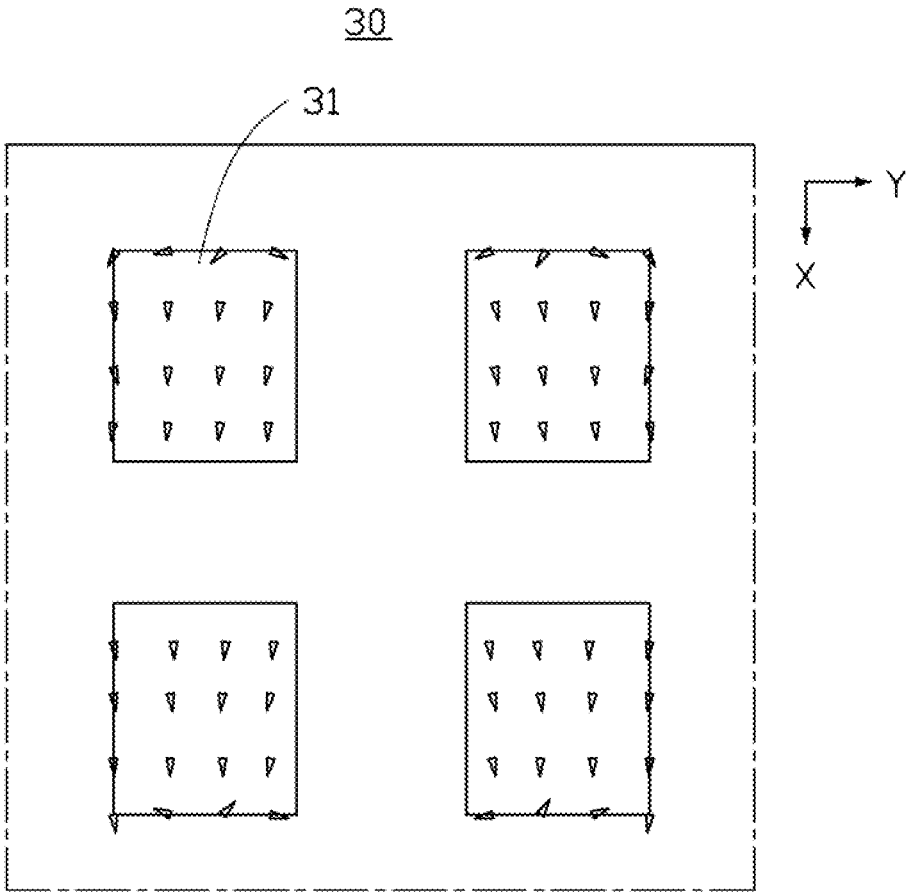
FIG. 4 is an isometric view of a first antenna array exhibiting horizontal polarization.
Figure 5:
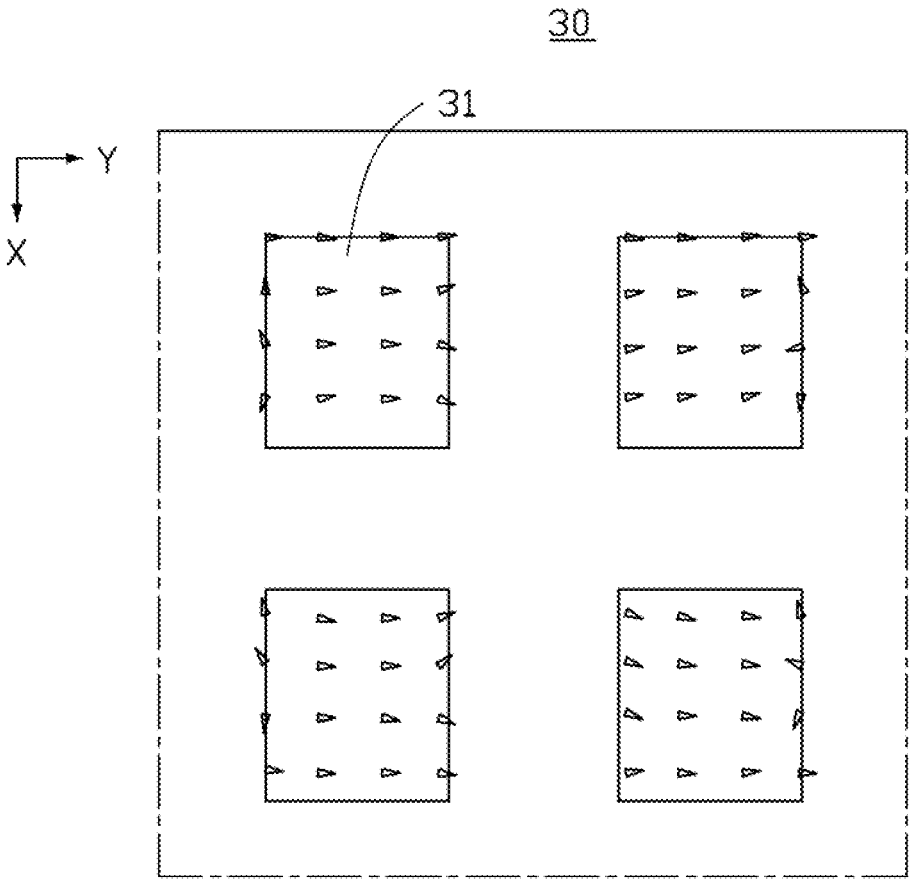
FIG. 5 is an isometric view of the first antenna array exhibiting a vertical polarization.

Referring to FIG. 4 and FIG. 5, when a current and signal flows from each first feeding portion 311, the current flows to each first antenna unit 31, and activates each first antenna unit 31 to radiate a wireless signal having a first polarization. When current and signal flows from each second feeding portion 312, the current flows to each first antenna unit 31, and each first antenna unit 31 radiate a wireless signal having a second polarization. In an embodiment, the first polarization direction is horizontal polarization, and the second polarization direction is vertical polarization. The horizontal polarization can be an X-Y plane polarization, and the vertical polarization can be a Z-direction polarization. In other embodiment, the first polarization direction and the second polarization direction can be other orientations of polarization.

Figure 6:
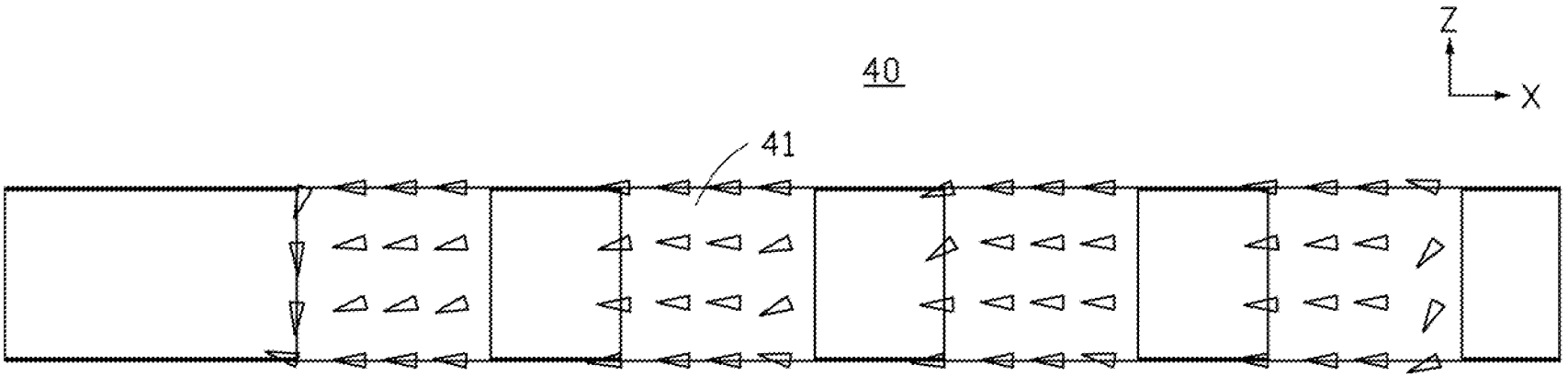
FIG. 6 is an isometric view of a Phi (φ) polarization orientation of a second antenna array of the antenna structure of FIG. 3.
Figure 7:
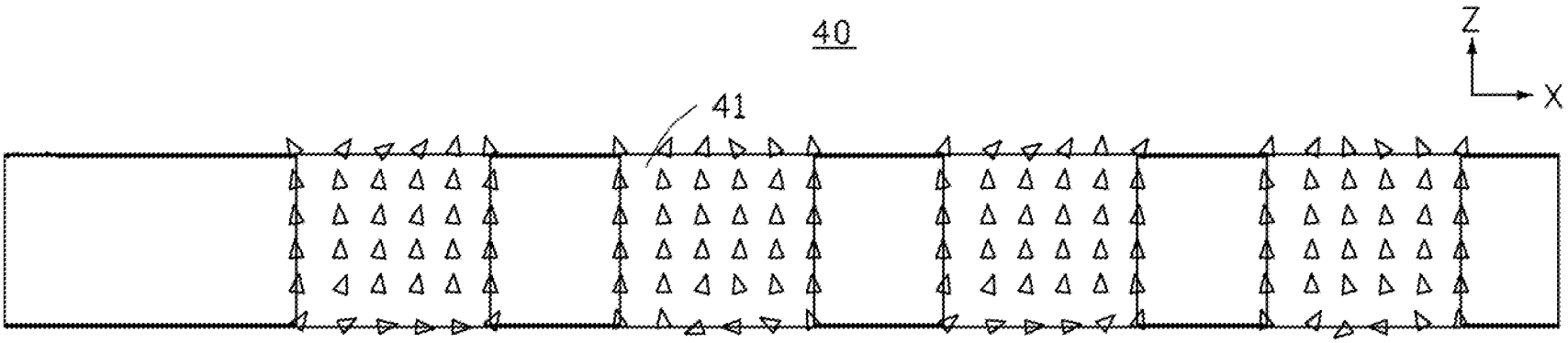
FIG. 7 is an isometric view of a Theta (θ) polarization orientation of the second antenna array.

Referring to FIG. 6 and FIG. 7, when the current and signal flows from each third feeding portion 414, the current flows to each second antenna unit 41, and each second antenna unit 41 radiate a wireless signal having a third polarization. When a current and signal flows from each fourth feeding portion 415, the current flows to each second antenna unit 41, and each second antenna unit radiate a wireless signal having a fourth polarization. In an embodiment, the third polarization direction is Phi (φ) direction of polarization, and the fourth polarization direction is Theta (θ) direction of polarization. The Phi is an angle on the X-Y plane, and the Theta is an angle on the Z-X plane. In other embodiment, the third and fourth polarizations can be other polarizations.

Figure 8:
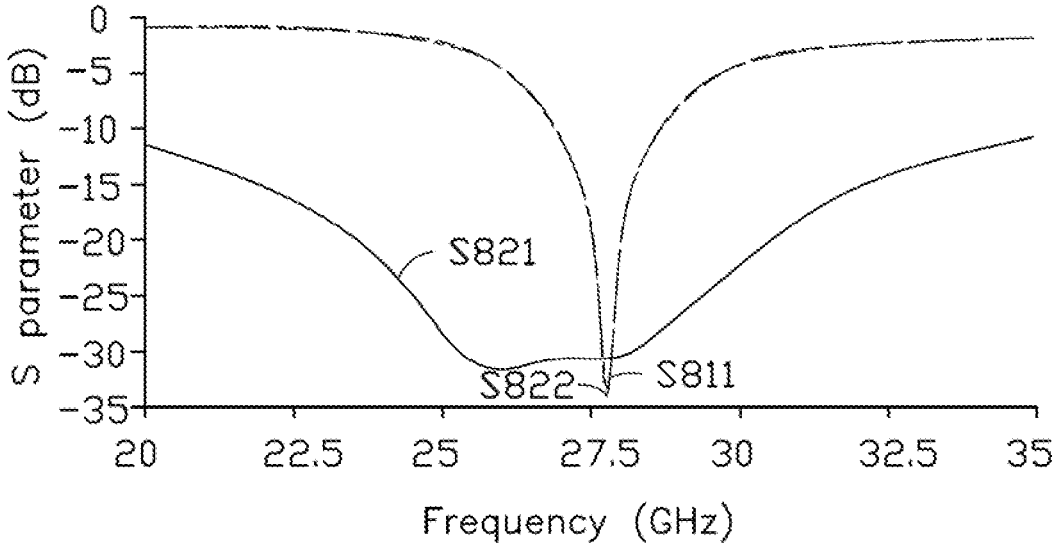
FIG. 8 is a scattering parameter graph of the first antenna array of the antenna structure of FIG. 3.

FIG. 8 shows a scattering parameter graph of the first antenna array 30. The curve S811 is a scattering parameter of the first feeding portion 311 of the first antenna unit 31. The curve S822 is a scattering parameter of the second feeding portion 311 of the first antenna unit 31. The curve S821 is an injection loss between the first feeding portion 311 and the second feeding portion 311 of the first antenna unit 31.

Figure 9:
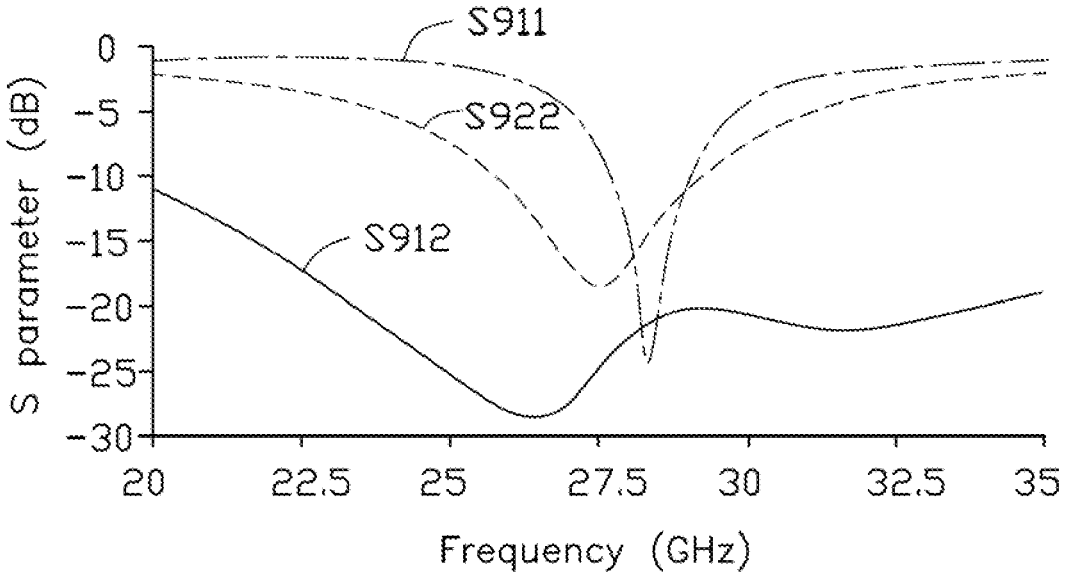
FIG. 9 is a scattering parameter graph of the second antenna array of the antenna structure of FIG. 3.

FIG. 9 shows a scattering parameter of the second antenna array 40. The curve S911 is a scattering parameter of the third feeding portion 414 of the second antenna unit 41. The curve S922 is a scattering parameter graph of the fourth feeding portion 415 of the second antenna unit 41. The curve S921 is an injection loss between the third feeding portion 414 and the fourth feeding portion 415 of the second antenna unit 41.

Figure 10:
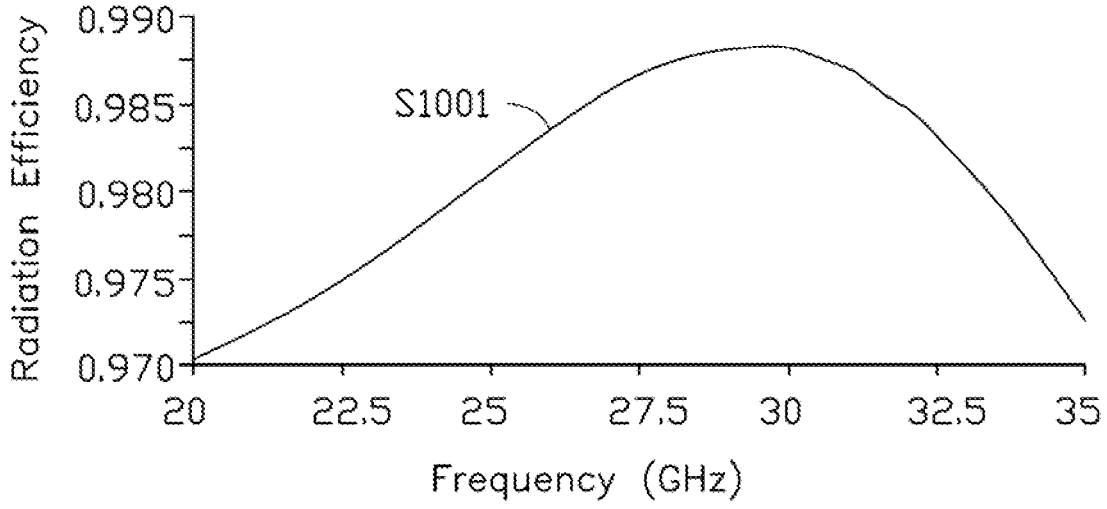
FIG. 10 is a graph showing radiation efficiency of the antenna structure of FIG. 3.

FIG. 10 shows a radiation efficiency graph of the antenna structure 100 in the form of the curve S1001.

The first antenna array 30 and the second antenna array 40 are respectively positioned on the surface and the side wall of the circuit board 10 of the antenna structure 100. The antenna structure 100 further activates the first antenna array 30 and the second antenna array 40 to radiate a wireless signal having multiple polarizations through the control circuit, which can improve a transmission efficiency of the antenna structure 100.

The embodiments shown and described above are only examples. Many details are often found in the art such as the other features of the antenna structure and the wireless communication device. Therefore, many such details are none of shown nor described. Even though numerous characteristics and advantages of the present technology have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure positioned on a circuit board, the circuit board comprising a side wall, an upper surface, and a lower surface opposite to the upper surface, the side wall connecting the upper surface and the lower surface, the antenna structure comprising:

a first antenna array positioned on one of the upper surface or the lower surface;

a second antenna array comprising a plurality of antenna units, a portion of each antenna unit positioned on the side wall, and the other portion of each antenna unit bended and positioned on at least one of the upper surface or the lower surface; and a control circuit configured to activate the first antenna array and the second antenna array to radiate a wireless signal having multiple polarizations;

wherein each antenna unit comprises a first folding portion, a second folding portion, and a main portion, the main portion is positioned on the side wall, and the first folding portion and the second folding portion are respectively bended to the main portion, and the first folding portion and the second folding portion are positioned on the upper surface and the lower surface, the first folding portion and the second folding portion are both rectangular-shaped, and a length of the first folding portion equals a length of the second folding portion, and a width of the first folding portion equals a width of the second folding portion.

2. The antenna structure of claim 1, wherein the first antenna array comprises N*M first antenna units, the second antenna array comprises 1*n second antenna units, a shape and size of each N*M first antenna units are the same, a shape and size of each 1*n second antenna units are the same, and n, N, and M are integers greater than 1.

3. The antenna structure of claim 2, wherein an edge distance between the N*M first antenna units is a half wavelength, and an edge distance between the 1*n second antenna units is the half wavelength.

4. The antenna structure of claim 1, wherein the first antenna array comprises a plurality of first antenna units, the plurality of antenna units of the second antenna array is a plurality of second antenna units, and each first antenna unit comprises a first feeding portion and a second feeding portion, the first feeding portion and the second feeding portion are separately configured to feed current signals to activate each first antenna unit to radiate a wireless signal having a first polarization and a second polarization, and each second antenna unit comprises a third feeding portion and a fourth feeding portion, the third feeding portion and the fourth feeding portion are separately configured to feed the current signals to activate each second antenna unit to radiate a wireless signal having a third polarization and a fourth polarization.

5. The antenna structure of claim 4, wherein the first polarization is vertical polarization, the second polarization is horizontal polarization, the third polarization is Phi direction of polarization, the fourth polarization is Theta direction of polarization.

6. The antenna structure of claim 4, wherein a length of each first antenna unit, a width of each first antenna unit, a length of each second antenna unit, and a width of each second antenna unit equal half wavelength.

7. The antenna structure of claim 4, wherein the antenna structure further comprises a ground portion, and the ground portion comprises a first ground plane, a second ground plane, a third ground plane, a fourth ground plane, a fifth ground plane, and at least one via, the via passes through from the upper surface to the lower surface, and the via is electrically connected to the first ground plane and the fifth ground plane.

8. The antenna structure of claim 7, wherein the first ground plane is positioned on the upper surface, the fifth ground plane is positioned on the lower surface, and the first feeding portion and the second feeding portion are electrically connected to the second ground plane, the third feeding portion passes through the fourth ground plane and is electrically connected to the control circuit, the fourth feeding portion passes through the third ground plane and is electrically connected to the control circuit.

9. The antenna structure of claim 1, wherein the control circuit is further configured to control radiation orientation or polarity of the first antenna array and the second array antenna.

10. A wireless communication device comprising a circuit board, and an antenna structure is positioned on the circuit board, the circuit board comprising a side wall, an upper surface, and a lower surface opposite to the upper surface, the side wall connecting the upper surface and the lower surface, wherein the antenna structure comprising:

a first antenna array positioned on one of the upper surface or the lower surface;

a second antenna array comprising a plurality of antenna units, a portion of each antenna unit positioned on the side wall, and the other portion of each antenna unit is bended and positioned on at least one of the upper surface or the lower surface; and a control circuit configured to activate the first antenna array and the second antenna array to radiate a wireless signal having multiple polarizations;

wherein each antenna units comprises a first folding portion, a second folding portion, and a main portion, the main portion is positioned on the side wall, and the first folding portion and the second folding portion are respectively bended to the main portion, and the first folding portion and the second folding portion are positioned on the upper surface and the lower surface, the first folding portion and the second folding portion are both rectangular-shaped, and a length of the first folding portion equals a length of the second folding portion, and a width of the first folding portion equals a width of the second folding portion.

11. The wireless communication device of claim 10, wherein the first antenna array comprises N*M first antenna units, the second antenna array comprises 1*n second antenna units, a shape and size of each N*M first antenna units are the same, a shape and size of each 1*n second antenna units are the same, and n, N, and M are integers greater than 1.

12. The wireless communication device of claim 11, wherein an edge distance between the N*M first antenna units is a half wavelength, and an edge distance between the 1*n second antenna units is the half wavelength.

13. The wireless communication device of claim 10, wherein the first antenna array comprises a plurality of first antenna units, the plurality of antenna units of the second antenna array is a plurality of second antenna units, and each first antenna unit comprises a first feeding portion and a second feeding portion, the first feeding portion and the second feeding portion are separately configured to feed current signals to activate each first antenna units to radiate a wireless signal having a first polarization and a second polarization, and each second antenna units comprises a third feeding portion and a fourth feeding portion, the third feeding portion and the fourth feeding portion are separately configured to feed the current signals to activate each second antenna units to radiate a wireless signal having a third polarization and a fourth polarization.

14. The wireless communication device of claim 13, wherein the first polarization is vertical polarization, the second polarization is horizontal polarization, the third polarization is Phi direction of polarization, the fourth polarization is Theta direction of polarization.

15. The wireless communication device of claim 13, wherein a length of each first antenna unit, a width of each first antenna unit, a length of each second antenna unit, and a width of each second antenna unit equal half wavelength.

16. The wireless communication device of claim 13, wherein the antenna structure further comprises a ground portion, and the ground portion comprises a first ground plane, a second ground plane, a third ground plane, a fourth ground plane, a fifth ground plane, and at least one via, the via passes through from the upper surface to the lower surface, and the via is electrically connected to the first ground plane and the fifth ground plane.

17. The wireless communication device of claim 16, wherein the first ground plane is positioned on the upper surface, the fifth ground plane is positioned on the lower surface, and the first feeding portion and the second feeding portion are electrically connected to the second ground plane, the third feeding portion passes through the fourth ground plane and is electrically connected to the control circuit, the fourth feeding portion passes through the third ground plane and is electrically connected to the control circuit.

18. The wireless communication device of claim 10, wherein the control circuit is further configured to control radiation orientation or polarity of the first antenna array and the second antenna array.

* * * * *